US010718337B2

(12) United States Patent
Parcell et al.

(10) Patent No.: US 10,718,337 B2
(45) Date of Patent: Jul. 21, 2020

(54) SELF-PRIMING DEDICATED WATER FEATURE PUMP

(71) Applicant: Hayward Industries, Inc., Berkeley Heights, NJ (US)

(72) Inventors: Jason W. Parcell, Pfafftown, NC (US); Scott Petty, Clemmons, NC (US); Douglas H. Philhower, Henderson, NV (US); Kevin L. Potucek, Far Hills, NJ (US); Gary Ortiz, Clemmons, NC (US); Jon Terence Stone, Clemmons, NC (US)

(73) Assignee: Hayward Industries, Inc., Berkeley Heights, NJ (US)

( * ) Notice: Subject to any disclaimer, the term of this patent is extended or adjusted under 35 U.S.C. 154(b) by 388 days.

(21) Appl. No.: 15/646,678

(22) Filed: Jul. 11, 2017

(65) Prior Publication Data

US 2018/0080449 A1 Mar. 22, 2018

Related U.S. Application Data

(60) Provisional application No. 62/398,228, filed on Sep. 22, 2016.

(51) Int. Cl.

| | |
|---|---|
| ***F04D 9/02*** | (2006.01) |
| ***F04D 29/40*** | (2006.01) |
| ***F04D 29/70*** | (2006.01) |

(52) U.S. Cl.

CPC ..... *F04D 9/02* (2013.01); *F04D 29/406* (2013.01); *F04D 29/708* (2013.01)

(58) Field of Classification Search

CPC ..... F04D 9/02; F04D 29/708; F04D 29/406

See application file for complete search history.

(56) References Cited

U.S. PATENT DOCUMENTS

| | | | |
|---|---|---|---|
| 2,096,595 | A | 10/1937 | Sanford |
| 2,250,021 | A | 7/1941 | Hofer |

(Continued)

FOREIGN PATENT DOCUMENTS

| | | | |
|---|---|---|---|
| AU | 2005204246 | A1 | 3/2006 |
| AU | 2007332716 | A1 | 6/2008 |

(Continued)

OTHER PUBLICATIONS

"Centrifugal Pumps: Basic Concepts of operation, Maintenance, and Troubleshooting," pp. from various Internet sources printed on Oct. 25, 2005 (17 pages).

(Continued)

*Primary Examiner* — Xiao En Mo

(74) *Attorney, Agent, or Firm* — McCarter & English, LLP

(57) ABSTRACT

A self-priming dedicated water feature pump is provided. The water feature pump can include a strainer housing connected to a pump housing. The strainer housing can include a reservoir for allowing water to enter the strainer housing so that the pump can self-prime. The strainer housing can also include a post installed within the reservoir. The post can function to prevent a strainer basket from being installed in the strainer housing. The post can be of sufficient volume and/or geometry to allow enough water to enter the strainer housing so that the water feature pump can self-prime while also preventing a strainer basket from being installed in the strainer housing.

30 Claims, 8 Drawing Sheets

(56) References Cited

U.S. PATENT DOCUMENTS

| | | | |
|---|---|---|---|
| D131,875 | S | 3/1942 | Houston |
| 2,572,263 | A | 10/1951 | Hofer |
| 2,603,234 | A | 7/1952 | Hofer |
| 2,632,355 | A | 3/1953 | Becker |
| 2,644,400 | A | 7/1953 | Hofer |
| 2,680,168 | A | 6/1954 | Murphy |
| 2,767,277 | A | 10/1956 | Wirth |
| 2,889,779 | A | 6/1959 | Hofer |
| 3,145,724 | A | 8/1964 | Pelzer |
| 3,195,556 | A | 7/1965 | Norstrud et al. |
| 3,252,479 | A | 5/1966 | Klock, Jr. |
| 3,403,718 | A | 10/1968 | Hughes |
| 3,456,549 | A | 7/1969 | Horton |
| 3,468,260 | A | 9/1969 | Belden |
| 3,557,857 | A | 1/1971 | Swenson |
| 3,637,331 | A | 1/1972 | Smith et al. |
| 3,744,635 | A | 7/1973 | Horvath |
| 3,781,925 | A | 1/1974 | Curtis et al. |
| 3,826,589 | A | 7/1974 | Frank et al. |
| 3,893,525 | A | 7/1975 | Dower et al. |
| 3,917,436 | A | 11/1975 | Dower |
| 3,920,352 | A | 11/1975 | Speck et al. |
| 3,957,395 | A | 5/1976 | Ensign |
| 3,966,358 | A | 6/1976 | Heimes et al. |
| 3,966,363 | A | 6/1976 | Rowley et al. |
| 4,107,492 | A | 8/1978 | Moon, Jr. et al. |
| 4,115,878 | A | 9/1978 | Johnson et al. |
| 4,116,577 | A | 9/1978 | Lauck |
| 4,180,374 | A | 12/1979 | Bristow |
| 4,182,216 | A | 1/1980 | DeCaro |
| D255,480 | S | 6/1980 | Zieg |
| 4,242,064 | A | 12/1980 | Uncles |
| 4,269,557 | A | 5/1981 | Kidd |
| 4,278,403 | A | 7/1981 | Shafer |
| 4,287,067 | A | 9/1981 | Dyner |
| 4,322,297 | A | 3/1982 | Bajka |
| 4,329,120 | A | 5/1982 | Walters |
| 4,353,846 | A | 10/1982 | Mehrens et al. |
| 4,377,360 | A | 3/1983 | Kennedy |
| 4,402,094 | A | 9/1983 | Sanders |
| 4,421,643 | A | 12/1983 | Frederick |
| 4,424,438 | A | 1/1984 | Antelman et al. |
| 4,444,546 | A | 4/1984 | Pazemenas |
| 4,456,432 | A | 6/1984 | Mannino |
| 4,473,470 | A | 9/1984 | Loutit |
| 4,505,643 | A | 3/1985 | Millis et al. |
| 4,525,125 | A | 6/1985 | Matsumoto et al. |
| 4,556,807 | A | 12/1985 | Yamada et al. |
| 4,558,238 | A | 12/1985 | Yamada et al. |
| 4,602,391 | A | 7/1986 | Shepherd |
| 4,616,215 | A | 10/1986 | Maddalena |
| 4,620,835 | A | 11/1986 | Bell |
| 4,629,557 | A | 12/1986 | Tobias |
| 4,659,235 | A | 4/1987 | Gilmore, Jr. et al. |
| 4,663,613 | A | 5/1987 | Raleigh et al. |
| 4,676,914 | A | 6/1987 | Mills et al. |
| 4,686,439 | A | 8/1987 | Cunningham et al. |
| 4,699,715 | A | 10/1987 | Lee, II |
| 4,724,074 | A | 2/1988 | Schaupp |
| 4,742,456 | A | 5/1988 | Kamena |
| 4,749,377 | A | 6/1988 | Mendizabal et al. |
| 4,773,823 | A | 9/1988 | Pease |
| 4,781,536 | A | 11/1988 | Hicks |
| 4,783,260 | A | 11/1988 | Kurihara |
| D299,143 | S | 12/1988 | Hazlehurst |
| 4,797,958 | A | 1/1989 | Guzzini |
| 4,799,048 | A | 1/1989 | Goshima et al. |
| 4,810,169 | A | 3/1989 | Kranzle |
| 4,861,231 | A | 8/1989 | Howard |
| 4,867,645 | A | 9/1989 | Foster |
| 4,871,303 | A | 10/1989 | Roesler |
| 4,898,513 | A | 2/1990 | Hon |
| 4,901,926 | A | 2/1990 | Klotzbach |
| 4,913,625 | A | 4/1990 | Gerlowski |
| 4,934,886 | A | 6/1990 | Aikens |
| 4,967,463 | A | 11/1990 | Pratt |
| 5,006,044 | A | 4/1991 | Walker, Sr. et al. |
| 5,012,535 | A | 5/1991 | Klotzbach |
| 5,040,950 | A | 8/1991 | Dalquist, III et al. |
| 5,057,081 | A | 10/1991 | Sunderland et al. |
| 5,064,347 | A | 11/1991 | LaValley, Sr. |
| 5,066,179 | A | 11/1991 | Pratt |
| 5,076,761 | A | 12/1991 | Krohn et al. |
| 5,076,763 | A | 12/1991 | Anastos et al. |
| 5,120,198 | A | 6/1992 | Clark |
| 5,146,943 | A | 9/1992 | Bert |
| 5,156,535 | A | 10/1992 | Budris et al. |
| 5,167,011 | A | 11/1992 | Priest |
| 5,167,041 | A | 12/1992 | Burkitt, III |
| 5,190,442 | A | 3/1993 | Jorritsma |
| 5,193,977 | A | 3/1993 | Dame |
| 5,199,836 | A | 4/1993 | Gogarty |
| 5,221,189 | A | 6/1993 | Henningsen |
| 5,240,379 | A | 8/1993 | Takashi et al. |
| 5,244,351 | A | 9/1993 | Amette |
| 5,251,125 | A | 10/1993 | Kamowski et al. |
| 5,255,398 | A | 10/1993 | Flynn et al. |
| 5,259,733 | A | 11/1993 | Gigliotti et al. |
| 5,278,455 | A | 1/1994 | Hamos |
| 5,294,045 | A | 3/1994 | Harris |
| 5,347,664 | A | 9/1994 | Hamza et al. |
| 5,361,215 | A | 11/1994 | Tompkins et al. |
| 5,365,964 | A | 11/1994 | Sorensen |
| 5,409,606 | A | 4/1995 | Spencer |
| 5,410,150 | A | 4/1995 | Teron et al. |
| 5,415,221 | A | 5/1995 | Zakryk |
| 5,422,014 | A | 6/1995 | Allen et al. |
| 5,464,327 | A | 11/1995 | Horwitz |
| 5,466,995 | A | 11/1995 | Genga |
| 5,475,619 | A | 12/1995 | Sugano et al. |
| 5,499,406 | A | 3/1996 | Chalberg et al. |
| 5,545,012 | A | 8/1996 | Anastos et al. |
| 5,550,753 | A | 8/1996 | Tompkins et al. |
| 5,559,720 | A | 9/1996 | Tompkins et al. |
| 5,570,481 | A | 11/1996 | Mathis et al. |
| 5,580,221 | A | 12/1996 | Triezenberg |
| 5,582,509 | A | 12/1996 | Quilty et al. |
| 5,585,025 | A | 12/1996 | Idland |
| 5,601,413 | A | 2/1997 | Langley et al. |
| 5,602,670 | A | 2/1997 | Keegan |
| 5,616,239 | A | 4/1997 | Wendell et al. |
| 5,624,559 | A | 4/1997 | Levin et al. |
| 5,658,131 | A | 8/1997 | Aoki et al. |
| 5,672,049 | A | 9/1997 | Ciurlo |
| 5,672,050 | A | 9/1997 | Webber et al. |
| 5,682,624 | A | 11/1997 | Ciochetti |
| 5,682,684 | A | 11/1997 | Wentzlaff et al. |
| 5,690,476 | A | 11/1997 | Miller |
| 5,707,211 | A | 1/1998 | Kochan, Sr. |
| 5,725,359 | A | 3/1998 | Dongo et al. |
| 5,730,861 | A | 3/1998 | Sterghos et al. |
| 5,739,648 | A | 4/1998 | Ellis et al. |
| 5,742,241 | A | 4/1998 | Crowley et al. |
| 5,742,954 | A | 4/1998 | Idland |
| 5,759,414 | A | 6/1998 | Wilkes et al. |
| 5,772,403 | A | 6/1998 | Allison et al. |
| 5,795,328 | A | 8/1998 | Bamitz et al. |
| 5,796,184 | A | 8/1998 | Kuhnl et al. |
| 5,809,796 | A | 9/1998 | Zakryk |
| 5,822,807 | A | 10/1998 | Gallagher et al. |
| 5,846,056 | A | 12/1998 | Dhindsa et al. |
| 5,858,234 | A | 1/1999 | Sukun |
| 5,865,601 | A | 2/1999 | Miller |
| 5,894,609 | A | 4/1999 | Barnett |
| 5,895,565 | A | 4/1999 | Steininger et al. |
| 5,897,787 | A | 4/1999 | Keller |
| 5,898,958 | A | 5/1999 | Hall |
| 5,909,372 | A | 6/1999 | Thybo |
| 5,947,689 | A | 9/1999 | Schick |
| 5,947,700 | A | 9/1999 | McKain et al. |
| 5,971,712 | A | 10/1999 | Kann |
| 5,983,416 | A | 11/1999 | Idland |
| 5,984,641 | A | 11/1999 | Bevan et al. |
| 5,991,939 | A | 11/1999 | Mulvey |

(56) References Cited

U.S. PATENT DOCUMENTS

| | | | |
|---|---|---|---|
| 6,003,165 | A | 12/1999 | Loyd |
| D419,567 | S | 1/2000 | Weiss |
| 6,038,712 | A | 3/2000 | Chalberg et al. |
| 6,039,543 | A | 3/2000 | Littleton |
| 6,041,453 | A | 3/2000 | Barrow et al. |
| 6,041,801 | A | 3/2000 | Gray et al. |
| 6,045,331 | A | 4/2000 | Gehm et al. |
| 6,053,193 | A | 4/2000 | Baker, Jr. |
| D425,911 | S | 5/2000 | Fleischer et al. |
| 6,059,536 | A | 5/2000 | Stingl |
| 6,065,941 | A | 5/2000 | Gray |
| 6,098,648 | A | 8/2000 | Bertoia |
| 6,098,654 | A | 8/2000 | Cohen |
| 6,099,264 | A | 8/2000 | Du |
| 6,123,510 | A | 9/2000 | Greer et al. |
| 6,149,407 | A | 11/2000 | Laing |
| 6,171,073 | B1 | 1/2001 | McKain et al. |
| 6,186,167 | B1 | 2/2001 | Grumstrup et al. |
| 6,187,179 | B1 | 2/2001 | Mayer et al. |
| 6,208,262 | B1 | 3/2001 | Jones |
| 6,227,808 | B1 | 5/2001 | McDonough |
| 6,251,285 | B1 | 6/2001 | Ciochetti |
| 6,253,227 | B1 | 6/2001 | Tompkins et al. |
| 6,253,391 | B1 | 7/2001 | Watanabe et al. |
| 6,261,065 | B1 | 7/2001 | Nayak et al. |
| 6,269,493 | B2 | 8/2001 | Sorensen |
| 6,273,686 | B1 | 8/2001 | Kroell et al. |
| 6,287,466 | B1 | 9/2001 | Yassin |
| 6,295,661 | B1 | 10/2001 | Bromley |
| 6,295,662 | B1 | 10/2001 | Idland et al. |
| D450,106 | S | 11/2001 | Herr |
| D450,327 | S | 11/2001 | Mod et al. |
| 6,329,778 | B1 | 12/2001 | Culp et al. |
| 6,341,387 | B1 | 1/2002 | Zars |
| 6,342,841 | B1 | 1/2002 | Stingl |
| 6,374,854 | B1 | 4/2002 | Acosta |
| 6,379,127 | B1 | 4/2002 | Andrews et al. |
| 6,390,781 | B1 | 5/2002 | McDonough |
| 6,407,469 | B1 | 6/2002 | Cline et al. |
| 6,433,791 | B2 | 8/2002 | Selli et al. |
| 6,438,446 | B1 | 8/2002 | Trachier |
| 6,445,332 | B1 | 9/2002 | Younger et al. |
| 6,445,966 | B1 | 9/2002 | Younger et al. |
| 6,461,113 | B1 | 10/2002 | Gaudet et al. |
| 6,464,464 | B2 | 10/2002 | Sabini et al. |
| 6,468,052 | B2 | 10/2002 | McKain et al. |
| D466,522 | S | 12/2002 | Huang |
| 6,497,554 | B2 | 12/2002 | Yang et al. |
| 6,547,529 | B2 | 4/2003 | Gross |
| 6,554,587 | B2 | 4/2003 | Paolini et al. |
| 6,568,416 | B2 | 5/2003 | Tucker et al. |
| 6,590,188 | B2 | 7/2003 | Cline et al. |
| 6,591,863 | B2 | 7/2003 | Ruschell et al. |
| 6,615,594 | B2 | 9/2003 | Jayanth et al. |
| 6,623,245 | B2 | 9/2003 | Meza et al. |
| 6,625,824 | B1 | 9/2003 | Lutz et al. |
| 6,643,108 | B2 | 11/2003 | Cline et al. |
| 6,651,900 | B1 | 11/2003 | Yoshida |
| 6,657,546 | B2 | 12/2003 | Navarro et al. |
| 6,659,717 | B1 | 12/2003 | Kao |
| 6,659,980 | B2 | 12/2003 | Moberg et al. |
| 6,662,384 | B1 | 12/2003 | Gardenier et al. |
| 6,663,349 | B1 | 12/2003 | Discenzo et al. |
| 6,676,382 | B2 | 1/2004 | Leighton et al. |
| 6,676,831 | B2 | 1/2004 | Wolfe |
| 6,687,923 | B2 | 2/2004 | Dick et al. |
| 6,691,047 | B1 | 2/2004 | Fredericks |
| 6,705,360 | B1 | 3/2004 | Bonzer |
| 6,709,240 | B1 | 3/2004 | Schmalz et al. |
| 6,709,241 | B2 | 3/2004 | Sabini et al. |
| 6,716,348 | B1 | 4/2004 | Morgan |
| 6,747,367 | B2 | 6/2004 | Cline et al. |
| 6,770,043 | B1 | 8/2004 | Kahn |
| 6,779,205 | B2 | 8/2004 | Mulvey et al. |
| 6,783,328 | B2 | 8/2004 | Lucke et al. |
| 6,796,776 | B2 | 9/2004 | Jolley et al. |
| 6,810,915 | B2 | 11/2004 | Umetsu et al. |
| 6,823,232 | B2 | 11/2004 | Murphy |
| 6,824,354 | B2 | 11/2004 | Laing |
| 6,866,774 | B1 | 3/2005 | Stephenson |
| 6,874,175 | B2 | 4/2005 | Laflamme et al. |
| 6,902,378 | B2 | 6/2005 | Gaudet et al. |
| D507,579 | S | 7/2005 | Rossman et al. |
| 6,926,502 | B2 | 8/2005 | Lin et al. |
| 6,939,109 | B2 | 9/2005 | Takahashi et al. |
| 6,939,463 | B2 | 9/2005 | Leaverton |
| 6,955,637 | B1 | 10/2005 | Montano et al. |
| 6,957,742 | B1 | 10/2005 | Pillart |
| 6,974,303 | B2 | 12/2005 | Wang |
| 6,976,052 | B2 | 12/2005 | Tompkins et al. |
| 7,001,159 | B2 | 2/2006 | Peterson, Jr. et al. |
| D517,570 | S | 3/2006 | Stiles, Jr. et al. |
| 7,063,791 | B2 | 6/2006 | Miner |
| 7,069,510 | B2 | 6/2006 | Anderson et al. |
| 7,082,339 | B2 | 7/2006 | Murray et al. |
| 7,083,392 | B2 | 8/2006 | Meza et al. |
| 7,085,627 | B2 | 8/2006 | Bamberger et al. |
| 7,092,772 | B2 | 8/2006 | Murray et al. |
| 7,103,428 | B2 | 9/2006 | Varone et al. |
| 7,121,808 | B2 | 10/2006 | Van Brunt et al. |
| 7,122,928 | B2 | 10/2006 | Shindo |
| D533,512 | S | 12/2006 | Nakashima et al. |
| 7,167,087 | B2 | 1/2007 | Corrington et al. |
| D536,705 | S | 2/2007 | Griffin et al. |
| 7,188,378 | B2 | 3/2007 | Ryan |
| 7,191,998 | B1 | 3/2007 | Chalberg et al. |
| 7,203,977 | B2 | 4/2007 | Mattson, Jr. et al. |
| 7,223,337 | B1 | 5/2007 | Franzino et al. |
| D550,805 | S | 9/2007 | Hazlehurst |
| D551,256 | S | 9/2007 | Pecca et al. |
| 7,292,898 | B2 | 11/2007 | Clark et al. |
| D557,374 | S | 12/2007 | Pecca |
| 7,316,423 | B2 | 1/2008 | Rochelle |
| 7,334,743 | B2 | 2/2008 | Wintering et al. |
| D567,189 | S | 4/2008 | Stiles, Jr. et al. |
| D568,340 | S | 5/2008 | Stiles, Jr. et al. |
| 7,397,360 | B2 | 7/2008 | Corrington et al. |
| 7,424,753 | B2 | 9/2008 | Gruenwald |
| 7,454,802 | B2 | 11/2008 | Tennant et al. |
| 7,471,994 | B2 | 12/2008 | Ford et al. |
| 7,473,080 | B2 | 1/2009 | Kawada et al. |
| 7,484,938 | B2 | 2/2009 | Allen |
| 7,490,370 | B2 | 2/2009 | Macey et al. |
| D588,159 | S | 3/2009 | Griffin et al. |
| D590,842 | S | 4/2009 | Clark et al. |
| 7,519,431 | B2 | 4/2009 | Goetz et al. |
| 7,531,092 | B2 | 5/2009 | Hazlehurst |
| 7,540,721 | B2 | 6/2009 | Liedtke et al. |
| 7,595,726 | B2 | 9/2009 | Nissels et al. |
| 7,665,158 | B2 | 2/2010 | Castellote |
| 7,686,587 | B2 | 3/2010 | Koehl |
| 7,686,589 | B2 | 3/2010 | Stiles, Jr. et al. |
| 7,794,428 | B2 | 9/2010 | Estes et al. |
| 7,828,528 | B2 | 11/2010 | Estes et al. |
| 7,845,913 | B2 | 12/2010 | Stiles, Jr. et al. |
| 7,847,790 | B2 | 12/2010 | Bewley et al. |
| 7,854,597 | B2 | 12/2010 | Stiles, Jr. et al. |
| 7,874,808 | B2 | 1/2011 | Stiles |
| 7,878,766 | B2 | 2/2011 | Meza et al. |
| 7,931,447 | B2 | 4/2011 | Levin et al. |
| 8,019,479 | B2 | 9/2011 | Stiles et al. |
| 8,028,355 | B2 | 10/2011 | Reeder et al. |
| 8,043,070 | B2 | 10/2011 | Stiles, Jr. et al. |
| 8,182,212 | B2 | 5/2012 | Parcell |
| 8,186,517 | B2 | 5/2012 | Bowman et al. |
| 8,297,920 | B2 | 10/2012 | Ortiz et al. |
| 8,313,306 | B2 | 11/2012 | Stiles, Jr. et al. |
| 8,465,262 | B2 | 6/2013 | Stiles, Jr. et al. |
| 8,469,675 | B2 | 6/2013 | Stiles, Jr. et al. |
| 8,480,373 | B2 | 7/2013 | Stiles, Jr. et al. |
| 8,500,413 | B2 | 8/2013 | Stiles, Jr. et al. |
| 8,573,952 | B2 | 11/2013 | Stiles, Jr. et al. |
| 8,602,743 | B2 | 12/2013 | Stiles, Jr. et al. |
| 8,602,745 | B2 | 12/2013 | Stiles, Jr. et al. |

(56) References Cited

U.S. PATENT DOCUMENTS 8,734,098 B2 5/2014 Ortiz et al.
8,801,389 B2 8/2014 Stiles, Jr. et al.
8,840,376 B2 9/2014 Stiles, Jr. et al.
9,051,930 B2 6/2015 Stiles, Jr. et al.
9,079,128 B2 7/2015 Parcell et al.
9,360,017 B2 6/2016 Hansen
9,404,500 B2 8/2016 Stiles, Jr. et al.
9,551,344 B2 1/2017 Stiles, Jr. et al.
9,605,680 B2 3/2017 Stiles, Jr. et al.
2001/0021613 A1 9/2001 Fadeley et al.
2001/0041139 A1 11/2001 Sabini et al.
2002/0038169 A1 3/2002 Cline et al.
2002/0070611 A1 6/2002 Cline et al.
2002/0089236 A1 7/2002 Cline et al.
2002/0094277 A1 7/2002 Gaudet et al.
2002/0104158 A1 8/2002 Dick et al.
2002/0141877 A1 10/2002 Jayanth et al.
2002/0150476 A1 10/2002 Lucke et al.
2003/0006891 A1 1/2003 Wild et al.
2003/0017055 A1 1/2003 Fong
2003/0044000 A1 3/2003 Kfoury et al.
2003/0049134 A1 3/2003 Leighton et al.
2003/0106147 A1 6/2003 Cohen et al.
2003/0114942 A1 6/2003 Varone et al.
2003/0143090 A1 7/2003 Iritani et al.
2003/0172451 A1 9/2003 Loyd et al.
2003/0200761 A1 10/2003 Funahashi et al.
2004/0009075 A1 1/2004 Meza et al.
2004/0022599 A1 2/2004 Nagayama
2004/0091373 A1 5/2004 Terry et al.
2004/0140990 A1 7/2004 Prince et al.
2004/0149666 A1 8/2004 Leaverton
2004/0216225 A1 11/2004 Booth et al.
2004/0219025 A1 11/2004 Garcia-Ortiz
2004/0247411 A1 12/2004 Nagayama
2005/0019154 A1 1/2005 Dial
2005/0084401 A1 4/2005 Coray et al.
2005/0095150 A1 5/2005 Leone et al.
2005/0100455 A1 5/2005 Tuddenham
2005/0107896 A1 5/2005 Kucera et al.
2005/0118039 A1 6/2005 Shorten et al.
2005/0123408 A1 6/2005 Koehl
2005/0158194 A1 7/2005 Sloan et al.
2005/0158195 A1 7/2005 Peterson et al.
2005/0191184 A1 9/2005 Vinson
2005/0193485 A1 9/2005 Wolfe
2005/0196284 A1 9/2005 Gaudet et al.
2005/0226731 A1 10/2005 Mehlhorn et al.
2005/0260079 A1 11/2005 Allen
2006/0045750 A1 3/2006 Stiles
2006/0045751 A1 3/2006 Beckman et al.
2006/0045752 A1 3/2006 Beckman
2006/0088423 A1 4/2006 Brunet et al.
2006/0090255 A1 5/2006 Cohen
2006/0112480 A1 6/2006 Sisk
2006/0127227 A1 6/2006 Mehlhorn et al.
2006/0132458 A1 6/2006 Garfio et al.
2006/0204367 A1 9/2006 Meza et al.
2007/0056955 A1 3/2007 Maddox
2007/0056956 A1 3/2007 Maddox
2007/0058313 A1 3/2007 Maddox
2007/0058314 A1 3/2007 Maddox
2007/0058315 A1 3/2007 Maddox
2007/0061051 A1 3/2007 Maddox
2007/0073236 A1 3/2007 Mernoe et al.
2007/0114162 A1 5/2007 Stiles et al.
2007/0114168 A1 5/2007 Hazlehurt
2007/0138290 A1 6/2007 Salvato
2007/0154319 A1 7/2007 Stiles et al.
2007/0154320 A1 7/2007 Stiles et al.
2007/0154321 A1 7/2007 Stiles et al.
2007/0154322 A1 7/2007 Stiles et al.
2007/0154323 A1 7/2007 Stiles et al.
2007/0163929 A1 7/2007 Stiles et al.
2007/0183902 A1 8/2007 Stiles et al.
2007/0286723 A1 12/2007 Ihle et al.
2008/0003114 A1 1/2008 Levin et al.
2008/0013259 A1 1/2008 Barton et al.
2008/0045904 A1 2/2008 Estes et al.
2008/0048046 A1 2/2008 Wagner et al.
2008/0086810 A1 4/2008 Le
2008/0130910 A1 6/2008 Jobling et al.
2008/0134425 A1 6/2008 Tatum
2008/0180268 A1 7/2008 Nissels et al.
2008/0181786 A1 7/2008 Meza et al.
2008/0181788 A1 7/2008 Meza et al.
2008/0181790 A1 7/2008 Meza et al.
2008/0213101 A1 9/2008 Stimpson et al.
2009/0038696 A1 2/2009 Levin et al.
2009/0064406 A1 3/2009 Lawyer et al.
2009/0069749 A1 3/2009 Miller et al.
2009/0106890 A1 4/2009 Rosenau
2009/0132066 A1 5/2009 Hollaway
2009/0136363 A1 5/2009 Stiles, Jr. et al.
2009/0138587 A1 5/2009 Callaghan
2009/0145498 A1 6/2009 Bowman et al.
2009/0185914 A1 7/2009 Elnar
2009/0200245 A1 8/2009 Steinbrueck et al.
2009/0241252 A1 10/2009 Li
2009/0252616 A1 10/2009 Brunet et al.
2009/0255049 A1 10/2009 Rosenau
2009/0271921 A1 11/2009 Castellote
2009/0284108 A1 11/2009 Castellano et al.
2009/0311115 A1 12/2009 Ono et al.
2009/0320201 A1 12/2009 Wu
2009/0320202 A1 12/2009 Lawyer et al.
2010/0006158 A1 1/2010 Castellote et al.
2010/0049228 A1 2/2010 Kuehner et al.
2010/0064428 A1 3/2010 Loyd et al.
2010/0092308 A1 4/2010 Stiles, Jr. et al.
2010/0097040 A1 4/2010 Boisvert et al.
2010/0115715 A1 5/2010 Ortiz et al.
2010/0138786 A1 6/2010 McQueen
2010/0146696 A1 6/2010 Campbell et al.
2010/0183452 A1 7/2010 Bosua
2010/0247332 A1 9/2010 Stiles, Jr. et al.
2010/0254825 A1 10/2010 Stiles, Jr. et al.
2011/0076156 A1 3/2011 Stiles, Jr. et al.
2011/0091329 A1 4/2011 Stiles, Jr. et al.
2011/0213504 A1 9/2011 Cedrone et al.
2011/0228192 A1 9/2011 Hollaway
2011/0286859 A1 11/2011 Ortiz et al.
2012/0226383 A1 9/2012 Hollaway
2013/0027861 A1 1/2013 Rosenau et al.
2013/0129536 A1 5/2013 Robol et al.
2013/0180460 A1 7/2013 Stiles, Jr. et al.
2014/0027359 A1 1/2014 Stiles, Jr. et al.
2014/0064985 A1 3/2014 Stiles, Jr. et al.
2014/0169940 A1* 6/2014 Yokota ..... F04D 9/005 415/56.1
2014/0205465 A1 7/2014 Stiles, Jr. et al.
2014/0314582 A1 10/2014 Stiles, Jr. et al.
2014/0363308 A1 12/2014 Stiles, Jr. et al.
2015/0030463 A1 1/2015 Stiles, Jr. et al.
2015/0204334 A1 7/2015 Stiles, Jr. et al.
2015/0211531 A1 7/2015 Stiles, Jr. et al.
2015/0300358 A1 10/2015 Stiles, Jr. et al.
2016/0061204 A1 3/2016 Stiles, Jr. et al.
2016/0153456 A1 6/2016 Stiles, Jr. et al.
2016/0377094 A1* 12/2016 Choi ..... F04B 23/04 210/798
2017/0114788 A1 4/2017 Stiles, Jr. et al.

FOREIGN PATENT DOCUMENTS

CA 2582175 A1 3/2000
CA 2588584 A1 3/2000
CA 2517040 A1 2/2006
CA 2672410 A1 6/2008
CA 2672459 A1 6/2008
DE 3308862 A1 9/1984
DE 19938490 A1 3/2001
EP 0499506 A1 8/1992
EP 0601899 A1 6/1994

(56) References Cited

FOREIGN PATENT DOCUMENTS

| | | | |
|---|---|---|---|
| EP | 0657602 | A1 | 6/1995 |
| EP | 0674109 | A1 | 9/1995 |
| EP | 0735273 | A1 | 10/1996 |
| EP | 0863278 | A2 | 9/1998 |
| EP | 0971137 | A1 | 1/2000 |
| EP | 1018347 | A2 | 7/2000 |
| EP | 1262670 | A2 | 12/2002 |
| EP | 1267085 | A2 | 12/2002 |
| EP | 1429034 | A2 | 6/2004 |
| EP | 1485613 | A1 | 12/2004 |
| EP | 1630422 | A2 | 3/2006 |
| EP | 2102503 | A2 | 9/2009 |
| EP | 2122171 | A2 | 11/2009 |
| EP | 2122172 | A2 | 11/2009 |
| EP | 2267415 | A2 | 12/2010 |
| EP | 2273125 | A2 | 1/2011 |
| FR | 2672646 | A1 | 8/1992 |
| GB | 1590253 | A | 5/1981 |
| GB | 2199106 | A | 6/1988 |
| GB | 2352789 | A | 2/2001 |
| GB | 2361041 | A | 10/2001 |
| JP | S58-211599 | A | 12/1983 |
| JP | H06-341398 | A | 12/1994 |
| JP | 2000-220622 | A | 8/2000 |
| JP | 2000-220623 | A | 8/2000 |
| WO | 92/13195 | A1 | 5/1994 |
| WO | 94/10466 | A1 | 5/1994 |
| WO | 98/36339 | A1 | 8/1998 |
| WO | 98/59174 | A1 | 12/1998 |
| WO | 00/68575 | A2 | 11/2000 |
| WO | 2008/073329 | A2 | 6/2008 |
| WO | 2008/073330 | A2 | 6/2008 |
| WO | 2008/073413 | A2 | 6/2008 |
| WO | 2011/106530 | A1 | 9/2011 |
| WO | 2011/106557 | A1 | 9/2011 |

OTHER PUBLICATIONS cliff Wyatt, "Monitoring Pumps, World Pumps," www.worldpumps.com, dated Dec. 2004 (5 pages).

H2Flow Pool & Spa Products Division, "Eco-Flow-C Variable Frequency Drive for Commercial Swimming Pools & Nater Feature Pumps," brochure dated Sep. 2010 (7 pages).

Hayward Pool Products, Buyer's Guide and Parts Price List, effective Dec. 29, 2003 (4 pages).

Hayward Pool Products, "EcoStar & EcoStar Svrs Variable Speed Pumps," brochure copyright 2010 (6 pages).

Hayward Pool Products, EcoStar Variable Speed Pump and Drive Technical Guide, version 2, copyright 2011 (50 pages).

Hayward Pool Products, EcoStar Variable Speed Pump Owner's Manual, IS3400VSP Rev. B, copyright 2010 (32 pages).

Jandy ePump Series Pumps Installation and Operation Manual, Zodiac Pool systems, Inc., copyright 2009 (28 pages).

Pentair Pool Products, WhisperFlo Pump Owner's Manual, Jun. 5, 2001 (10 pages).

Pentair Pool Products, "WhisperFlo XF High Performance Pump," brochure (known prior to Dec. 9, 2011) (4 pages).

Pentair Water Pool and Spa, WhisperFlo XF and Max-E-Pro XF High Performance Pump Installation and User's Guide, Dec. 10, 2010 (20 pages).

Pentair Water Pool and Spa, "IntelliFlo 4/160 and 4/100 Variable Speed Programmable Pump . . . Installation and User's Guide," dated Feb. 15, 2006 (40 pages).

Pentair Water Pool and Spa, "IntelliFlo Variable Speed Programmable Pump . . . Installation and User's Guide," dated Jul. 26, 2011 (52 pages).

Pentair Water Pool and Spa, "IntelliFlo Variable Speed Pump . . . Installation and User's Guide," dated Dec. 29, 2005 (64 pages).

"Pentair's WhisperFlo Strainer Basket" photographs (known prior to Dec. 9, 2011) (14 pages).

"Sta-Rite Basket C8-58P" (Perspective and Six Orthogonal View Photographs) (2003) (7 pages).

Sta-Rite, "Max-E-Glass II and Dura-Glass II Centrifugal Pumps with Integral Trap," Owner's Manual (2003) (19 pages).

Sta-Rite, "IntelliPro 4x160 and 4x100 Four Speed Variable Centrifugal Pump with Integral Trap," Rev A, dated Oct. 18, 2006 (44 pages).

Teel Pumps Gear Brochure, "Rotary Gear Pumps and Vacuum-On Switch," (2000) (1 page).

Textron, Inc., Various Textron Bushings Printouts from http://www.avdel.textron.com (at least as early as Jan. 2006) (5 pages).

Webpage from www.pentairpool.com comparing the IntelliFlo Pump and the IntelliFlo 4 X 160 Pump (1 page), and brochure for Pentair Pool Products for IntelliFlo 4X160 Pump (4 pages), 2006.

* cited by examiner

SELF-PRIMING DEDICATED WATER FEATURE PUMP

RELATED APPLICATIONS

This application claims priority to U.S. Provisional Patent Application No. 62/398,228 filed on Sep. 22, 2016, the entire disclosure of which is incorporated herein by reference.

BACKGROUND

Field

The present invention relates to a pump, and, more specifically to a self-priming pump that is dedicated to pumping water to water features.

Related Art

A swimming pool has a filtration pump. The filtration pump of a swimming pool pumps water to the swimming pool and is therefore a key component of the circulation system in a pool. Filtration pumps are typically installed upstream of the pool filter. Because of this, filtration pumps include a strainer basket for removing large debris from the water and preventing the debris from entering the pump.

A swimming pool could also have added water features such as a spa, fountain, waterfall, etc. These water features may have a dedicated pump to provide circulation to that water feature. Pumps that provide circulation to water features are typically installed after the pool filter and therefore do not need a strainer basket. However, in the pool market today, filtration pumps are often used to supply water to the water features which renders the strainer basket of the filtration pump superfluous. Furthermore, there are dedicated water feature pumps without the strainer basket and without the reservoir where the strainer basket is installed. However, without the reservoir, dedicated water feature pumps of swimming pools are not known to self-prime.

Accordingly, there is a need for improvements in the design of water feature pumps where the water feature pumps can self-prime and also prevent a strainer basket from being installed in the water feature pump.

SUMMARY

A self-priming dedicated water feature pump is provided. The water feature pump can include a strainer housing connected to a pump housing. The strainer housing is an example embodiment of a priming reservoir, and references herein to the example embodiment of the strainer housing, shall be understood by a person of ordinary skill in the art to also encompass a reference to a priming reservoir more generally. The strainer housing can include a reservoir for allowing water to enter the strainer housing so that the water feature pump can self-prime. The strainer housing can also include a post installed within the reservoir. The post can function to prevent a strainer basket from being installed in the strainer housing. The post can be of sufficient volume and/or geometry to allow enough water to enter the strainer housing so that the water feature pump can self-prime while also preventing a strainer basket from being installed in the strainer housing. A cap can also be installed on the post to prevent a strainer basket from being installed in the strainer housing. The cap can be removable to allow for debris removal.

BRIEF DESCRIPTION OF THE DRAWINGS

The foregoing features and others will be apparent from the following Detailed Description, taken in connection with the accompanying drawings, in which.

DETAILED DESCRIPTION OF THE INVENTION

The present invention relates to a self-priming dedicated water feature pump, as discussed in detail below in connection with FIGS. 1-10.

Figure 1:
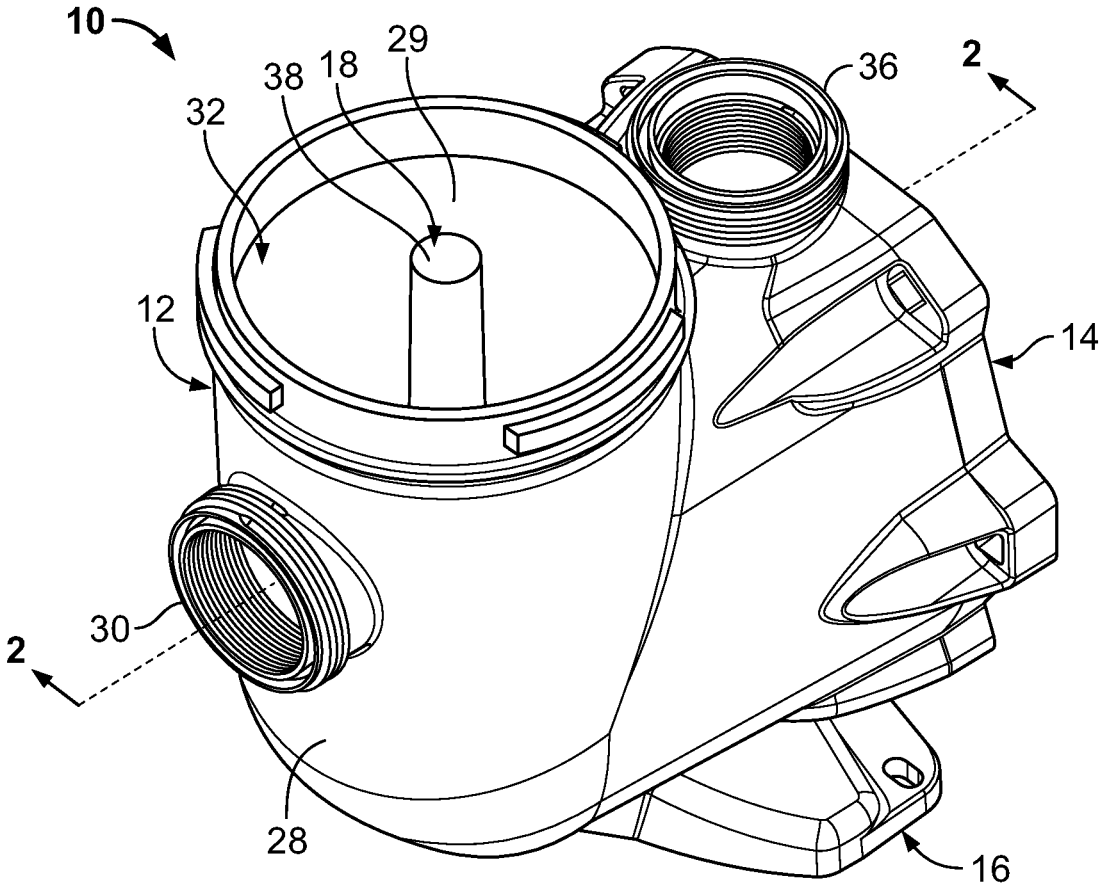
FIG. 1 is a perspective view of an embodiment of a water feature pump of the present disclosure.

FIG. 1 is a perspective view of a water feature pump 10 of the present disclosure. The water feature pump 10 includes a strainer housing 12, a pump housing 14, a base 16, and a prevention means for preventing the installation of a strainer basket in the strainer housing 12 (e.g., a post 18). The strainer housing 12 can be integrally formed with the pump housing 14. The strainer housing 12 can also be connected to the pump housing 14 through other mechanical means such as gluing, fastening or snap-fitting. The strainer housing 12 and the pump housing 14 can define a substantially perpendicular relationship relative to each other, with the strainer housing 12 extending upwardly (vertically) with respect to the base 16 and the pump housing 14 extending rearwardly (horizontally) with respect to the strainer housing 12.

Figure 2:
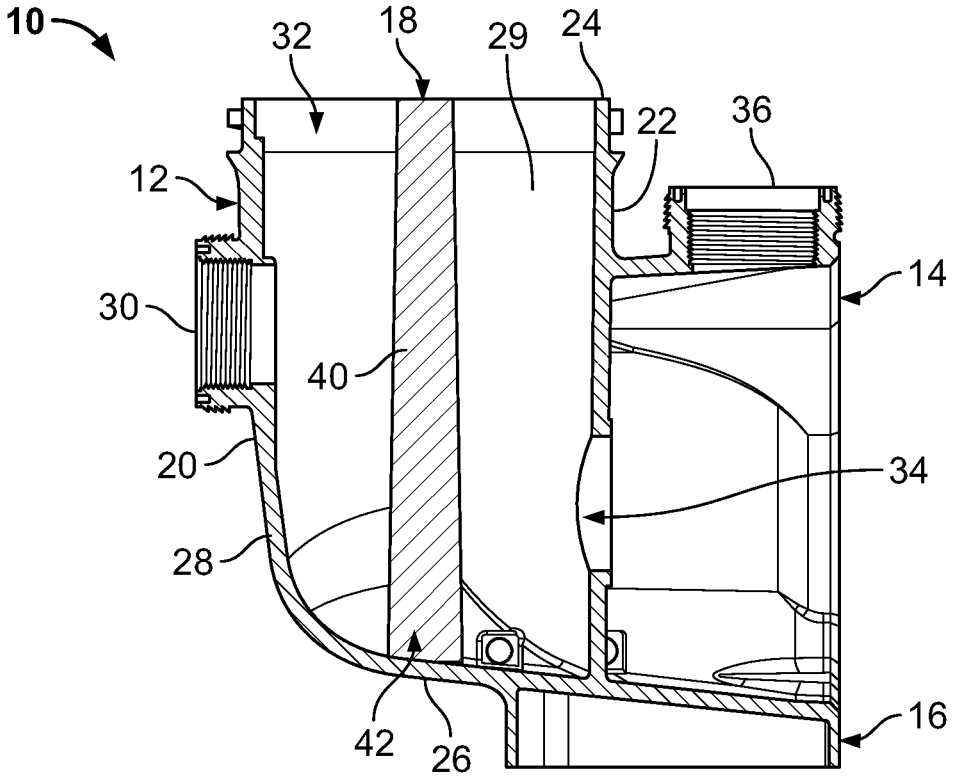
FIG. 2 is a sectional view of the embodiment of FIG. 1 taken along line 2-2 thereof.

FIG. 2 is a sectional view of the water feature pump 10 of the present disclosure along line 2-2 in FIG. 1. As can be seen, the strainer housing 12 includes a front end 20 and a rear end 22, the rear end 22 being opposite to the front end 20. The strainer housing 12 further includes a top end 24 and a bottom end 26, the bottom end 26 being opposite to the top end 24. The front end 20, the rear end 22, the top end 24, and the bottom end 26 together form an outer wall 28 and an inner wall 29 of the strainer housing 12. The front end 20 can include an inlet 30 for receiving an inflow conduit (e.g., a pipe, a hose, and/or a connector therefor). The inlet 30 can be threaded to receive and secure the inflow conduit. The top end 24 can form an opening to a reservoir 32. The reservoir 32 is an empty cavity shaped by the outer wall 28 and the inner wall 29. The shape of the outer wall 28, the inner wall 29 and the reservoir 30 can be any suitable shape known to those of ordinary skill in the art to accomplish the objectives of the present disclosure as described herein. The size of the reservoir 32 can be a suitable size to retain a sufficient amount of water as will be discussed in greater detail below.

The reservoir 32 can include a removed portion 34. The removed portion 34 can be located on the rear end 22 of the strainer housing 12 which facilitates water to flow from the strainer housing 12 to the pump housing 14. The pump housing 14 can include an outlet 36 so that the flow of water can move from the inlet 30 of the strainer housing 12 through the removed portion 34 into the pump housing 14 and exit the outlet 36. The outlet 36 can be threaded to receive an outflow conduit for directing the flow of water out of the water feature pump 10 to the water features, such as spa jets, waterfall, fountain, deck jet, laminar, bubbler, vanishing edge, etc.

As noted above, the water feature pump 10 also includes the post 18. The post 18 can include a top portion 38, a body 40, and a bottom portion 42. The post 18 can be shaped in a cylindrical fashion or any other suitable shape to accomplish the function of the present disclosure as will be discussed in greater detail below. The bottom portion 42 of the post 18 can be secured to the bottom of the inner wall 29 which abuts the bottom end 26 of the strainer housing 12. The bottom portion 42 of the post 18 can be secured permanently using any suitable mechanism known to those of skill in the art. For example, the post 18 can be integrally formed with the bottom of the inner wall 29 or fastened mechanically with an adhesive, screw, or snap-fit mechanism. The post 18 can alternatively be removable from the reservoir 32 and need not be permanently affixed to the inner wall 29. As will be discussed in greater detail below, removing the post 18, can allow the water feature pump 10 to be converted from a dedicated water feature pump to a traditional filtration pump. The thickness of the body 40 of the post 18 should be a suitable size in relation to the reservoir 32 to allow for a sufficient amount of water to fill into the reservoir 32. The purpose of allowing a sufficient amount of water into the reservoir 32 will be explained in greater detail below.

Figure 3:
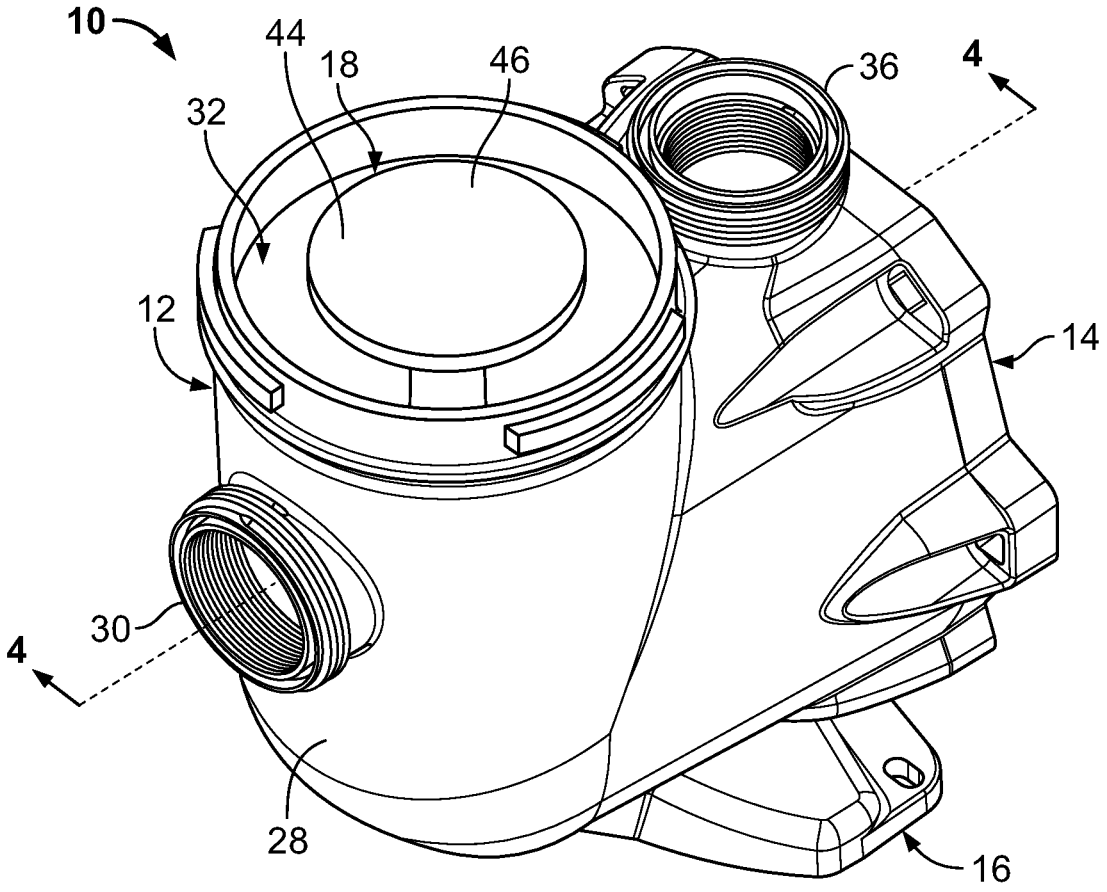
FIG. 3 is a perspective view of an embodiment of a water feature pump with a cap of the present disclosure.
Figure 4:
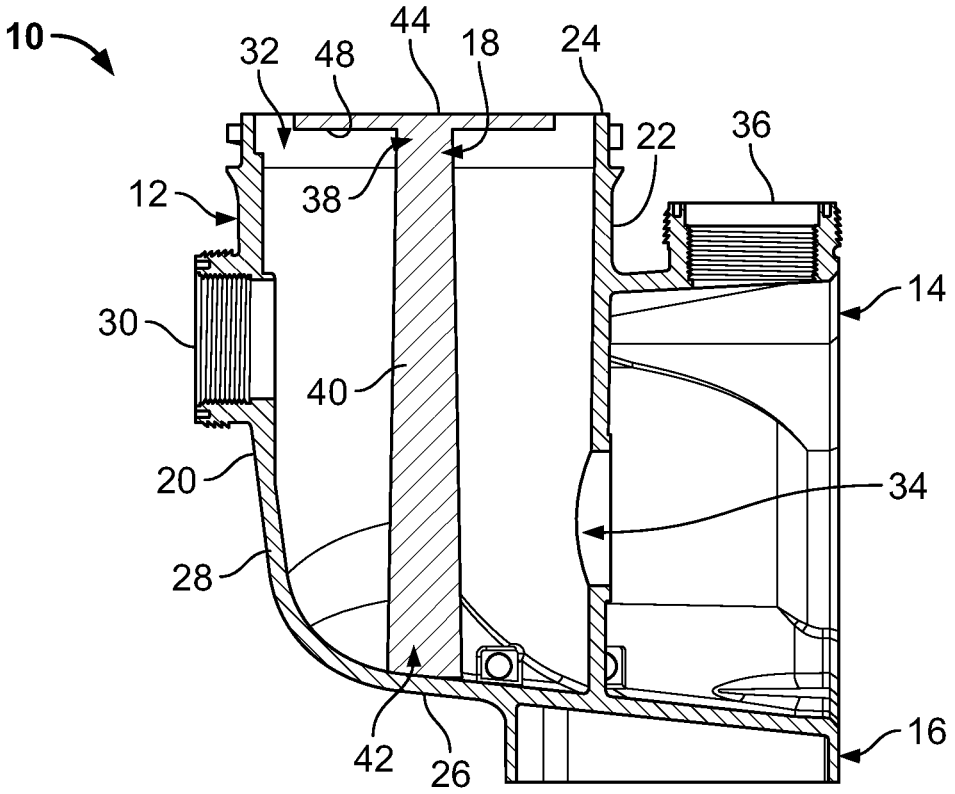
FIG. 4 is a sectional view of the water feature pump and cap of FIG. 3 taken along line 4-4 thereof.

An alternative embodiment of the post 18 is shown in connection with FIGS. 3 and 4. More specifically the post 18 could include a cap 44 secured to the top portion 38 (shown in FIG. 1) of the post 18. The cap 44 can include a top side 46 and a bottom side 48. As shown in FIG. 4, the distance between the top side 46 and the bottom side 48 (e.g., the thickness) can be of any distance so as to allow for sufficient amount of water to fill into the reservoir 32. The purpose of allowing a sufficient amount of water will be explained in greater detail below. Furthermore, the cap 44 can be secured to the top portion 38 by any means known to those of skill in the art, including, but not limited to, using an adhesive, screws or a snap-fit mechanism. The cap 44 can be a removable from the post 18 to allow for debris removal. If debris removal is not required, the cap 44 can be secured to the post 18 permanently. Furthermore, the cap 44 can be integrally formed with the post 18 so as to form a single unit secured to the bottom of the inner wall 29 of the strainer housing 12.

In another embodiment, the post 18 can be designed to be removable from the inner wall 29 and reservoir 32. For example, the means for installing the post 18 can be done in a removable manner such by using a screw or a snap-fit mechanism. If such a removable mechanism is used, the post 18 can be removed by unscrewing or snapping out the post 18 from the inner wall 29. Removing the post 18 from the reservoir 32 allows the water feature pump 10 to be transformed from a dedicated water feature pump to a traditional filtration pump. The traditional filtration pump which has no post 18 allows a strainer basket to be installed in the reservoir 32 and therefore can be installed before a filter and can self-prime. If the post 18 was installed in the reservoir 32 by permanently fastening the post 18 to the inner wall 29, then the present disclosure can allow for a strainer basket to be shaped so that the strainer basket can be installed over the post 18 and be within the reservoir 32. For example, the strainer basket could include a long tube that would accept the post 18 and fit within the reservoir 32 as shown in FIGS. 1 and 2. The strainer basket could also just have an opening or a gap in the bottom of the basket to fit over the post 18 so that when the strainer basket is installed, the opening or gap would fit snug with the post 18 to prevent debris bypass.

The water feature pump 10 can function as a dedicated water feature pump that allows for self-priming while also preventing the installation of a strainer basket. A strainer basket may not be needed for the water feature pump 10 because the water feature pump 10 can be installed after the filter to provide circulation to various water features. It may still desirable to include a strainer housing 12 to allow the water feature pump 10 to self-prime. Therefore, the post 18 can be installed within the reservoir 32 of the strainer housing 12 to prevent installation of a strainer basket. The thickness of the body 40 of the post 18 can be a certain amount relative to the size of the reservoir 32 so to allow a sufficient amount of water to enter the reservoir 32 to allow the water feature pump 10 to self-prime. Alternatively, the volume of the post 18 can be such that it allows for a sufficient amount of water to be available in the reservoir 32 to allow the water feature pump 10 to self-prime. The geometry of the post 18 can be any type of geometry known to those of skill in the art to make it difficult to design a new strainer basket that could be retrofitted to the strainer housing 12. Additionally, the cap 44 can be added to the post 18 such that a strainer basket modified to fit in the strainer housing 12 would need to be so small so as to render it useless.

Figure 5:
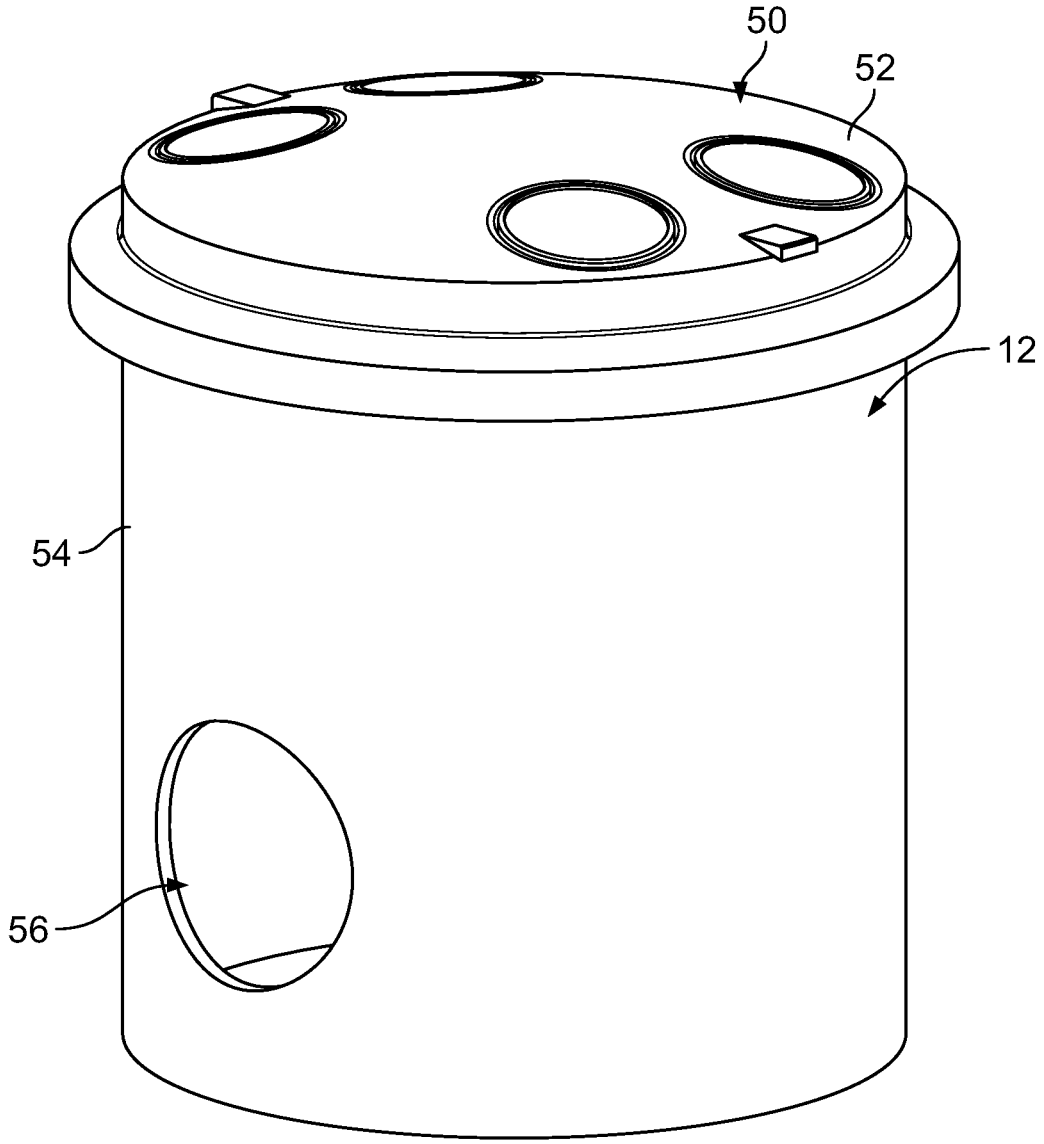
FIG. 5 is a perspective view of an embodiment of a reservoir cover for a strainer housing of a water feature pump.

An alternate embodiment for a water feature pump 10 is shown in FIG. 5. In this embodiment, the strainer housing 12 is covered with a prevention means for preventing the installation of a strainer basket in the strainer housing 12 (e.g., a priming reservoir cover 50). The priming reservoir cover 50 can include a top cover 52, an extended wall 54 and an inlet aperture 56. The top cover 52 and the extended wall 54 can be integrally formed with each other or they can be mechanically fastened to each other by any means known in the art. The priming reservoir cover 50 can be integrally formed with the strainer housing 12 or it can be permanently fastened with the strainer housing 12. If desired, the priming reservoir cover 50 can be mechanically fastened with the strainer housing 12 to allow for removal of the priming reservoir cover 50 from the strainer housing 12. When installed, the extended wall 54 has a diameter just greater than the outer wall 28 of the strainer housing 12 and can be placed (e.g., concentrically) over the outer wall 28 of the strainer housing 12 with any suitable seal (or, in some embodiments, the extended wall 54 has a diameter just less than within the outer wall 28 and can be placed (e.g., concentrically) within the outer wall 28 with any suitable seal). The top cover 52 can fully cover the top end 24 of the strainer housing 12 and thereby prevent a strainer basket from being installed in the reservoir 32. The inlet aperture 56 can be aligned with the inlet 30 to allow for water flow into the strainer housing 12. This configuration prevents a strainer basket from being installed in the strainer housing 12 by virtue of the top cover 52. The extended wall 54 further facilitates tampering and removal of the top cover 52 from the strainer housing 12. The priming reservoir cover 50 can alternatively be a singular piece of material such as plastic. The reservoir cover 50 can be installed permanently with the strainer housing 12 to prevent installation of a strainer basket in the strainer housing 12, however, the reservoir cover 50 can be mechanically fastened to allow for removal of the reservoir cover 50 if debris removal is desired or if the water feature pump 10 is desired to be converted to a traditional filtration pump. In this embodiment a post 18 is not necessary to prevent installation of the strainer basket, and therefore can allow more water in the reservoir 32 to allow the pump 10 to self-prime. The post 18 can be included to provide for an additional means for preventing the installation of the strainer basket in the strainer housing 12.

Figure 6:
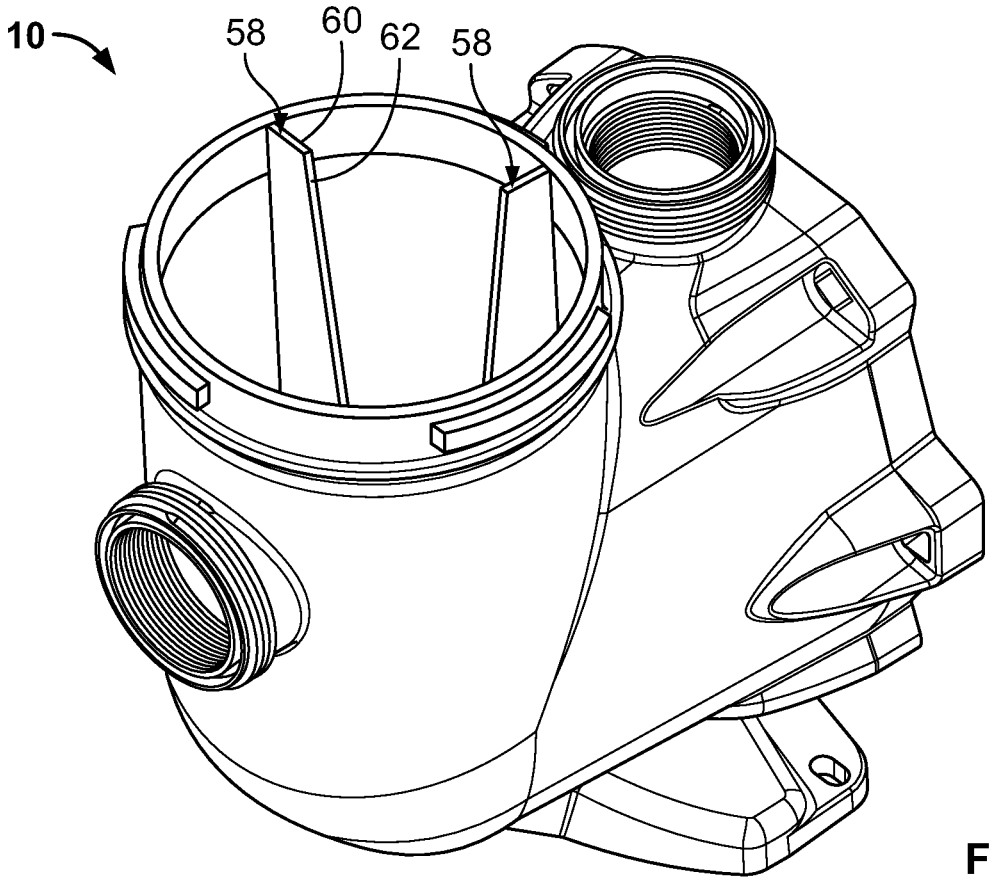
FIG. 6 is a perspective view of an embodiment of a water feature pump with a plurality of ribs.
Figure 7:
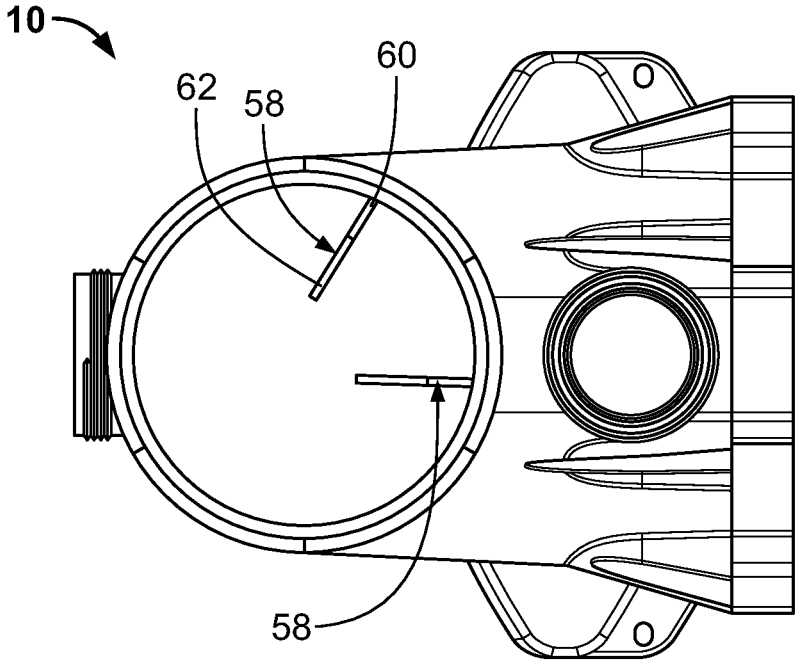
FIG. 7 is a top view of an embodiment of a water feature pump and a plurality of ribs.

An alternate embodiment of the water feature pump 10 is shown in FIG. 6. A top-down view of this embodiment is shown in FIG. 7. In this embodiment, the strainer housing 12 includes a prevention means for preventing the installation of a strainer basket in the strainer housing 12 (e.g., a plurality of ribs 58). The plurality of ribs 58 can be formed along the inner wall 29 of the strainer housing 12. The plurality of ribs 58 can be integrally formed or permanently fastened with the inner wall 29. By way of a non-limiting example, the plurality of ribs 58 can be molded into the inner wall 29. Alternatively, the plurality of ribs 58 can be mechanically fastened with the inner wall 29 to allow for the removal of the ribs if debris removal is required or if it is desired that the pump 10 be converted from a dedicated water feature pump to a traditional filtration pump. The plurality of ribs 58 can extend outwardly from the inner wall 29. The plurality of ribs 58 can each be shaped in a triangular fashion or any other shape suitable for preventing installation of a strainer basket. In some embodiments, the ribs are removably received by the strainer housing (e.g., in receiving grooves/channels formed therein). The plurality of ribs 58 can have a top side 60 and a distal end 62. The shape of the plurality of ribs 58, including the length of the top side 60 and the distal end 62, can be of any shape, length and thickness to prevent installation of a strainer basket. The shape of the plurality of ribs 58, including the length of the top side 60 and the distal end 62, can also be of any shape, length and thickness to allow for enough water to fill the reservoir 30 to allow the pump 10 to self-prime. The plurality of ribs 58 can be circumferentially displaced with respect to the reservoir 32 to prevent the installation of a strainer basket. The amount of the plurality of ribs 58 can be any number sufficient to prevent the installation of a strainer basket while allowing enough water to fill the reservoir 32 to allow the pump 10 to self-prime.

Figure 8:
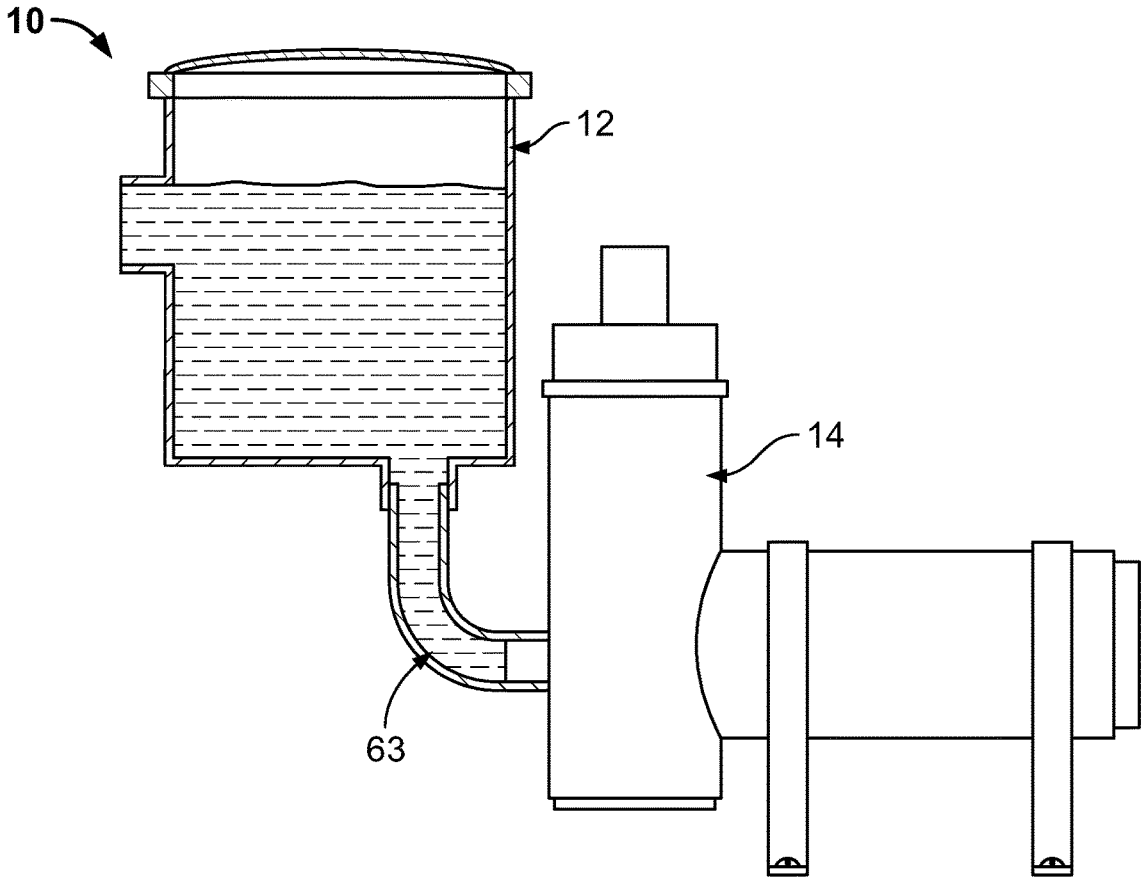
FIG. 8 is a side view of an embodiment of a water feature pump with a remotely installed strainer housing.

An alternate embodiment of the water feature pump 10 is shown in FIG. 8. In this embodiment, the strainer housing 12 is installed remotely from the pump housing 14. The strainer housing 12 can be installed at a higher vertical level than the pump housing 14 or at the same level as the pump housing 14. Positioning the strainer housing 12 above the pump housing 14 allows the strainer housing to maintain a constant flooded system to allow the pump 10 to self-prime. Any of the prevention means discussed in the present application for preventing a strainer basket from being installed in the strainer housing 12 can also be used in this embodiment. Any of the prevention means can be permanently fastened to the strainer housing 12 or can optionally be removable. A pipe 63 can be used to connect the strainer housing 12 to the pump housing 14 to allow water to flow from the strainer housing 12 to the pump housing 14. The pipe 63 can be any suitable size. The pipe 63 can be over-sized, for example. The pipe can be, for example, 8 inches and include a body for a 2-2.5 inch system.

Figure 9:
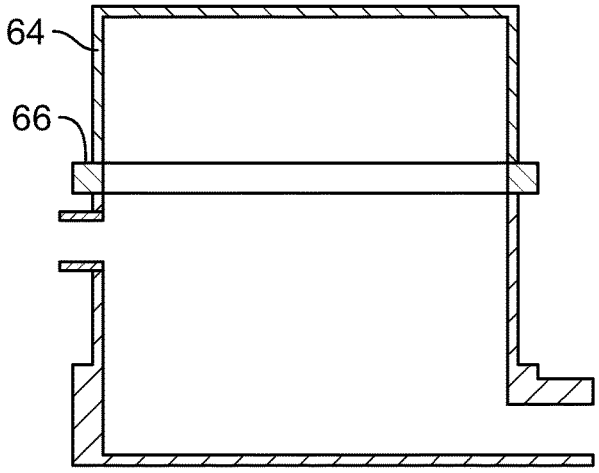
FIG. 9 is a schematic side view of an embodiment of a strainer housing with a top cover of the water feature pump.

Referring to FIG. 9, an embodiment is shown schematically. In this embodiment, a prevention means for preventing a top cover 64 is placed over the strainer housing 12 to prevent the installation of a strainer basket in the strainer housing 12. The top over 64 is placed over the entirety of the top end 24 of the strainer housing such that the reservoir 32 is covered. The top cover 64 can be secured to the strainer housing 12 with a flange connection 66. Any other suitable means of connecting the top cover 64 with the strainer housing 12 can be used. In this embodiment, the reservoir is "flipped" to prevent top entry in the strainer housing 12. As with other embodiments, the top cover 64 can be permanently secured to the strainer housing 12 or it can be removably secured to allow for debris removal or the conversion from a dedicated water feature pump to a traditional filtration pump.

Figure 10:
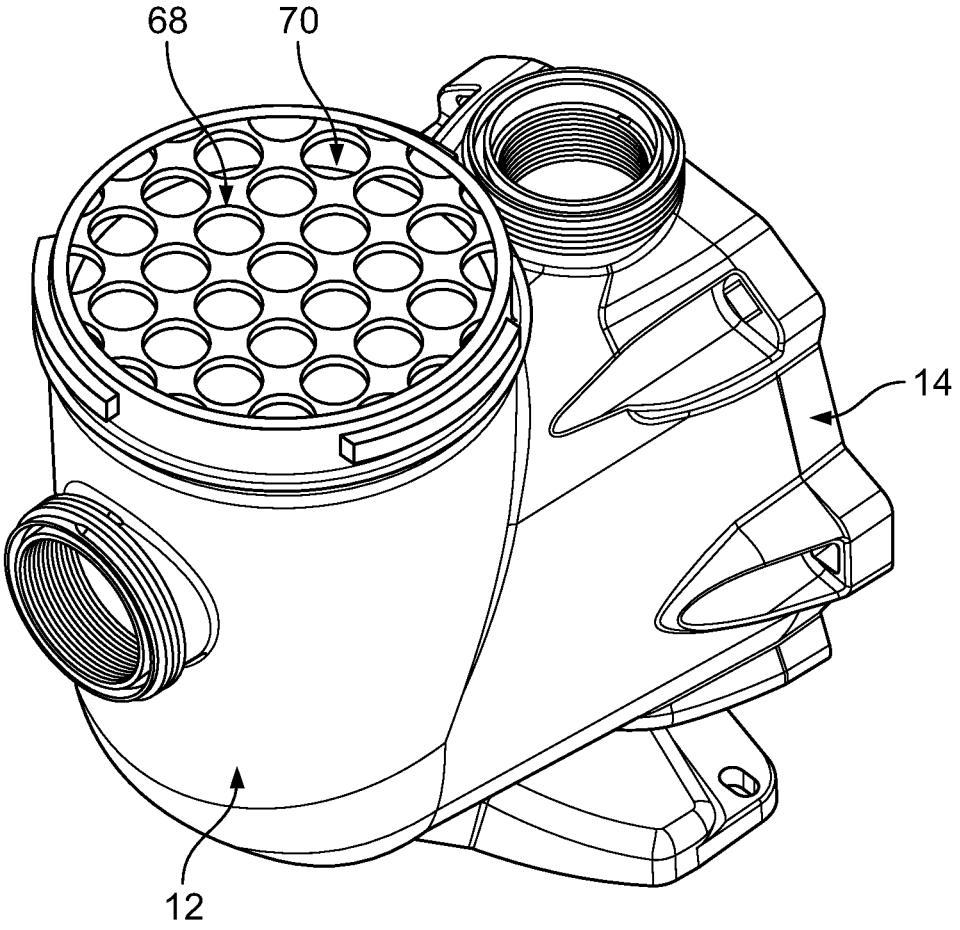
FIG. 10 is a perspective view of an embodiment of a water feature pump with a screen.

An alternate embodiment of the water feature pump 10 is shown in FIG. 10. In this embodiment, a prevention means for preventing the installation of a strainer basket in the strainer housing 12 can be installed with the strainer housing 12. The prevention means can be a perforated means for preventing the installation of a strainer basket in the strainer housing 12 (e.g., a screen 68). The screen 68 can be integrally formed with the strainer housing 12 to prevent installation of a strainer basket in the reservoir 32. The screen 68 can alternatively be permanently mechanically fastened to the strainer housing 12. The screen 68 can also be removably fastened to the strainer housing 12 to allow for debris removal or to allow the pump 10 to be converted from a dedicated water feature pump to a traditional filtration pump. The screen 68 can include a plurality of apertures 70. The screen 68 can be installed at the top end 24, above the reservoir 32. This would allow for enough water to fill the reservoir 32 to allow the pump 10 to self-prime while also preventing the installation of a strainer basket. The screen 68 can be a grate, mesh or similar type of perforated/grated feature.

Having thus described the invention in detail, it is to be understood that the foregoing description is not intended to limit the spirit or scope thereof. It will be understood that the embodiments of the present invention described herein are merely exemplary and that a person skilled in the art may make any variations and modification without departing from the spirit and scope of the invention. All such variations and modifications, including those discussed above, are intended to be included within the scope of the invention.

What is claimed is:

1. A dedicated water feature pump comprising:

a base;

a strainer housing connected to the base and extending upwardly with respect to the base, the strainer housing defining a reservoir for receiving water through an inlet and an inner wall;

a pump housing connected to the strainer housing and extending rearwardly with respect to the strainer housing;

a prevention means installed in the reservoir for preventing installation of a strainer basket in the strainer housing;

wherein the strainer housing allows the pump to self-prime by preventing a strainer basket from being installed in the strainer housing.

2. The dedicated water feature pump of claim 1, wherein the prevention means is a post.

3. The dedicated water feature pump of claim 2, comprising a cap installed on the post to further prevent installation of a strainer basket in the strainer housing.

4. The dedicated water feature pump of claim 1, comprising a hole between the strainer housing and the pump housing to allow water to flow from the strainer housing to the pump housing.

5. The dedicated water feature pump of claim 4 in combination with a water feature, said water feature being one of a spa jet, waterfall/sheer fall, rain curtain, fountain, deck jet, laminar jet, bubbler, scupper, spillover, vanishing/negative edge, or misting/fog system.

6. The combination of claim 5, wherein said pump housing has an outlet for communicating water to said water feature via an outflow conduit.

7. The dedicated water feature pump of claim 2, wherein the post is removable to allow for the removal of debris from the strainer housing and to allow the pump to be used as a filtration pump.

8. A dedicated water feature pump comprising:

a base;

a strainer housing connected to the base and extending upwardly with respect to the base, the strainer housing defining a reservoir for receiving water through an inlet and an inner wall;

a pump housing connected to the strainer housing and extending rearwardly with respect to the strainer housing;

a cover installed over the strainer housing for preventing a strainer basket from being installed in the reservoir;

wherein the strainer housing allows the pump to self-prime absent the strainer basket.

9. The dedicated water feature pump of claim 8, comprising an extended wall extending downward from the cover, the extended wall having an aperture corresponding to the inlet of the strainer housing to allow water to enter the reservoir.

10. The dedicated water feature pump of claim 8, comprising a hole between the strainer housing and the pump housing to allow water to flow from the strainer housing to the pump housing.

11. The dedicated water feature pump of claim 8 in combination with a water feature, said water feature being one of a spa jet, waterfall/sheer fall, rain curtain, fountain, deck jet, laminar jet, bubbler, scupper, spillover, vanishing/negative edge, or misting/fog system.

12. The combination of claim 11, wherein said pump housing has an outlet for communicating water to said water feature via an outflow conduit.

13. The dedicated water feature pump of claim 8, wherein the cover is removable to allow for the removal of debris from the strainer housing and to allow the pump to be used as a filtration pump.

14. A dedicated water feature pump comprising:

a base;

a strainer housing connected to the base and extending upwardly with respect to the base, the strainer housing defining a reservoir for receiving water through an inlet and an inner wall;

a pump housing connected to the strainer housing and extending rearwardly with respect to the strainer housing;

a plurality of ribs installed in the reservoir for preventing a strainer basket from being installed in the reservoir;

wherein the strainer housing allows the pump to self-prime absent the strainer basket.

15. The dedicated water feature pump of claim 14, wherein at least one of the plurality of ribs is triangularly shaped.

16. The dedicated water feature pump of claim 14, comprising a hole between the strainer housing and the pump housing to allow water to flow from the strainer housing to the pump housing.

17. The dedicated water feature pump of claim 14 in combination with a water feature, said water feature being one of a spa jet, waterfall/sheer fall, rain curtain, fountain, deck jet, laminar jet, bubbler, scupper, spillover, vanishing/negative edge, or misting/fog system.

18. The combination of claim 17, wherein said pump housing has an outlet for communicating water to said water feature via an outflow conduit.

19. The dedicated water feature pump of claim 14, wherein at least one of the plurality of ribs is removable to allow for the removal of debris from the strainer housing and to allow the pump to be used as a filtration pump.

20. A dedicated water feature pump comprising:

a strainer housing defining a reservoir for receiving water through an inlet and an inner wall, the strainer housing including a means for preventing a strainer basket from being installed in the strainer housing;

a pump housing connected to the strainer housing through a pipe, the pump housing being installed at a lower vertical level with respect to the strainer housing;

wherein the position of the strainer housing with respect to the pump housing allows the strainer housing to be flooded with water to allow the pump to self-prime.

21. The dedicated water feature pump of claim 20, wherein the prevention means includes at least one of a post, a screen, and a top cover.

22. The dedicated water feature pump of claim 20 in combination with a water feature, said water feature being one of a spa jet, waterfall/sheer fall, rain curtain, fountain, deck jet, laminar jet, bubbler, scupper, spillover, vanishing/negative edge, or misting/fog system.

23. The combination of claim 22, wherein said pump housing has an outlet for communicating water to said water feature via an outflow conduit.

24. The dedicated water feature pump of claim 20, wherein the prevention means is removable to allow for the removal of debris from the strainer housing and to allow the pump to be used as a filtration pump.

25. A dedicated water feature pump comprising:

a base;

a priming reservoir housing connected to the base and extending upwardly with respect to the base, the priming reservoir housing defining a reservoir for receiving water through an inlet and an inner wall;

a pump housing connected to the priming reservoir housing and extending rearwardly with respect to the priming reservoir housing;

a perforated means for preventing the installation of a strainer basket in the priming reservoir housing installed above the reservoir;

wherein the priming reservoir housing allows the pump to self-prime absent the strainer basket.

26. The dedicated water feature pump of claim 25, wherein the perforated means includes at least one of a screen, a grate, or a mesh.

27. The dedicated water feature pump of claim 25, comprising a hole between the priming reservoir and the pump housing to allow water to flow from the priming reservoir housing to the pump housing.

28. The dedicated water feature pump of claim 25 in combination with a water feature, said water feature being one of a spa jet, waterfall/sheer fall, rain curtain, fountain, deck jet, laminar jet, bubbler, scupper, spillover, vanishing/negative edge, or misting/fog system.

29. The combination of claim 27, wherein said pump housing has an outlet for communicating water to said water feature via an outflow conduit.

30. The dedicated water feature pump of claim 25, wherein the performated means is removable to allow for the removal of debris from the priming reservoir housing and to allow the pump to be used as a filtration pump.

* * * * *